United States Patent [19]

McGrath

[11] Patent Number: 4,900,632

[45] Date of Patent: Feb. 13, 1990

[54] DECORATIVE MULTI-LOOP DEVICE

[75] Inventor: Paul F. McGrath, Overland Park, Kans.

[73] Assignee: Hallmark Cards, Inc., Kansas City, Mo.

[21] Appl. No.: 320,118

[22] Filed: Mar. 7, 1989

[51] Int. Cl.[4] ..... D04D 7/10

[52] U.S. Cl. ..... 428/542.8; 28/147; 223/46; 428/5

[58] Field of Search ..... 428/415, 542.8; 28/147; 223/46

[56] References Cited

U.S. PATENT DOCUMENTS

| | | | |
|---|---|---|---|
| 2,660,826 | 12/1953 | Bennett | 428/4 X |
| 2,774,164 | 12/1956 | James | 428/5 |
| 3,850,293 | 11/1974 | Scaringi | 428/5 X |
| 4,840,689 | 6/1989 | Raiskums et al. | 428/4 X |

OTHER PUBLICATIONS

Canadian Design Registration No. 53756 dated Dec. 24, 1984.

Hallmark Cards, Inc. catalog for "Department Store Market" dated Feb. 1, 1987.

*Primary Examiner*—Henry F. Epstein

*Attorney, Agent, or Firm*—Neuman, Williams, Anderson & Olson

[57] ABSTRACT

A decorative multi-loop device is provided which is formed from at least one blank of foldable sheet material. The blank includes a central section and a plurality of loop-forming segments extending laterally outwardly from the central section. A loop-retaining unit cooperates with the central section and distal end portions of the segments to retain each segment in a loop configuration.

21 Claims, 2 Drawing Sheets

FIG. 1
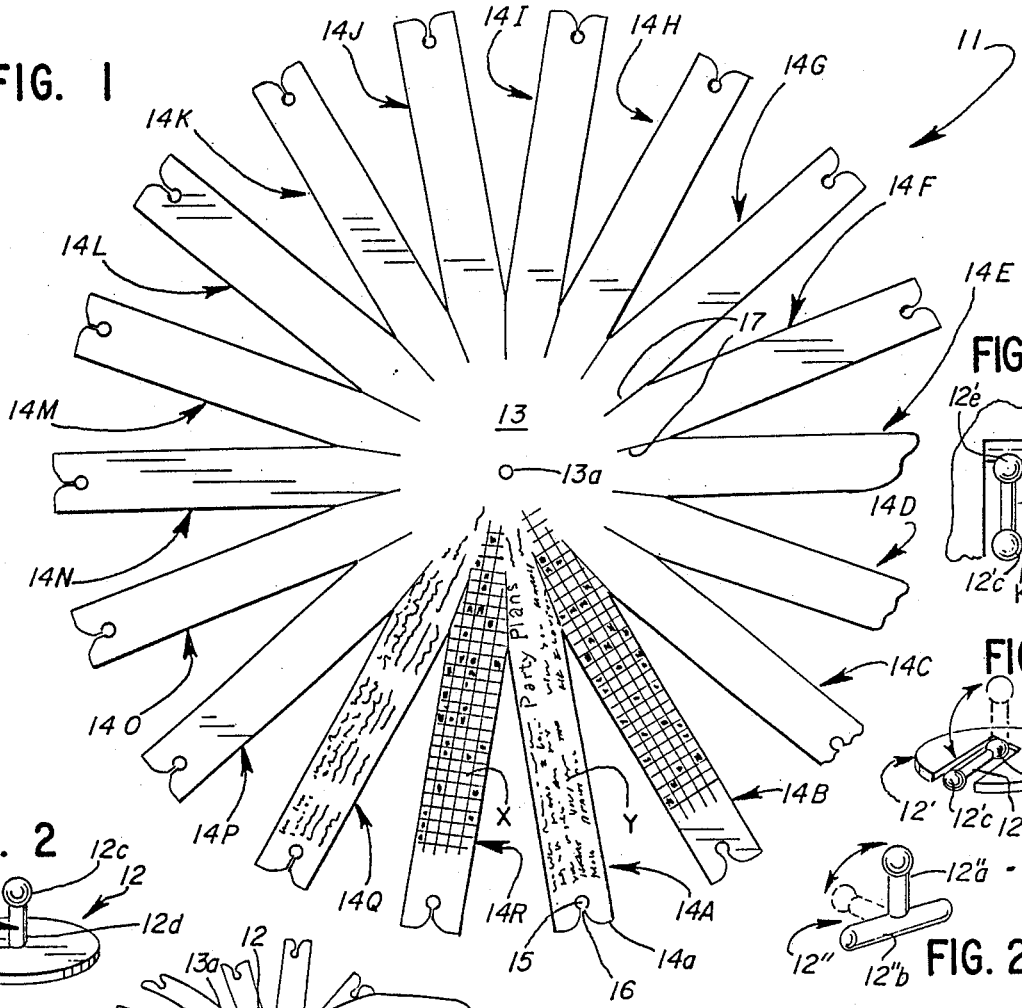
FIG. 2AA
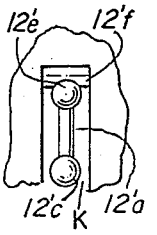
FIG. 2A
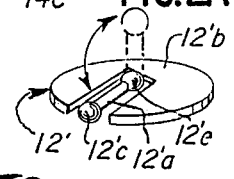
FIG. 2
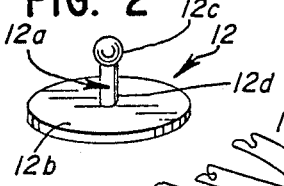
FIG. 2B
FIG. 3
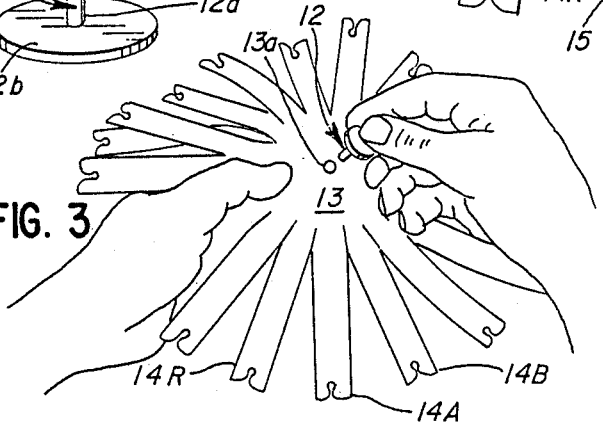
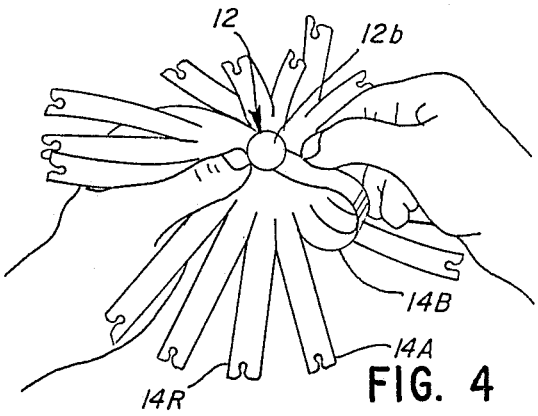
FIG. 4
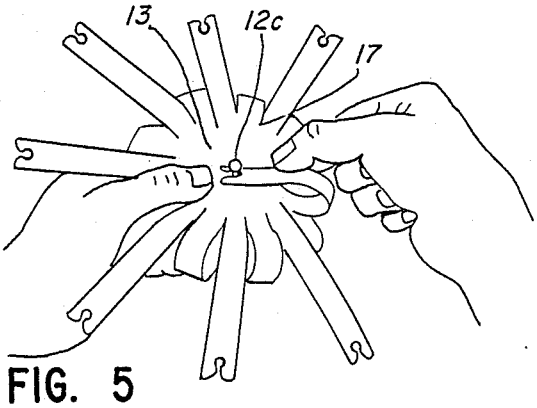
FIG. 5
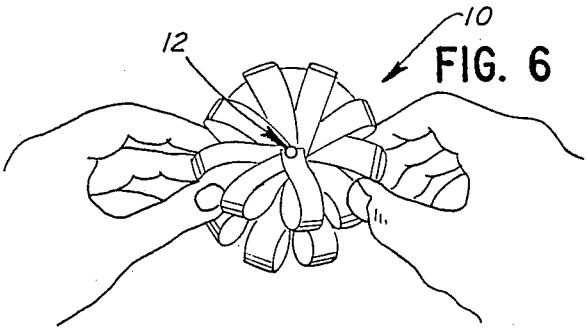
FIG. 6

FIG. 7
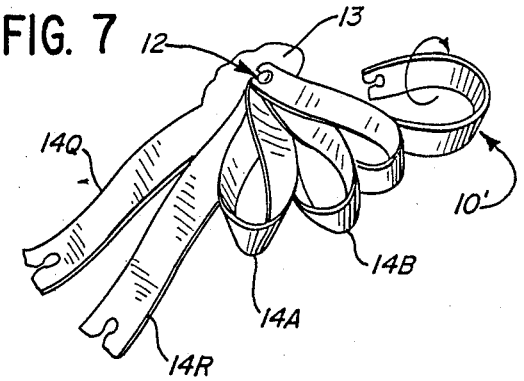
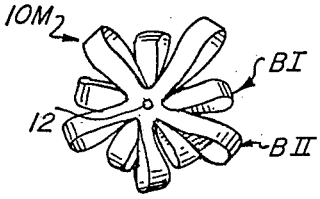
FIG. 11
FIG. 9
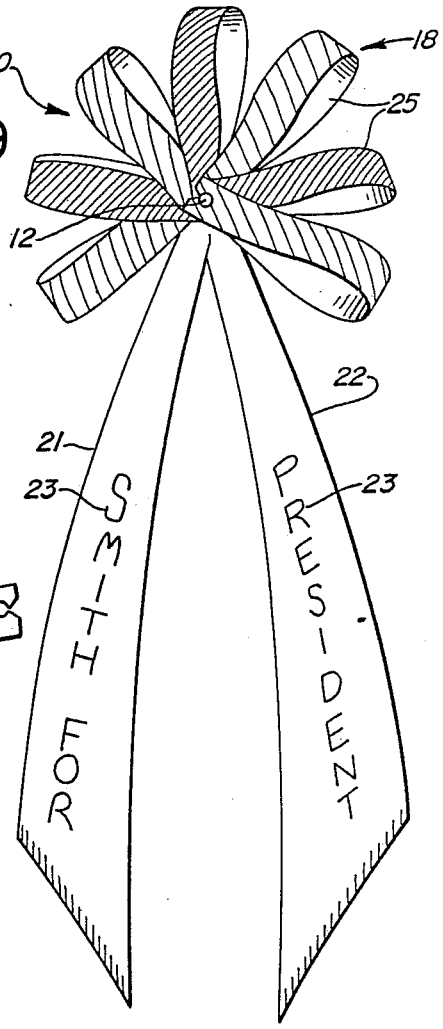
FIG. 8
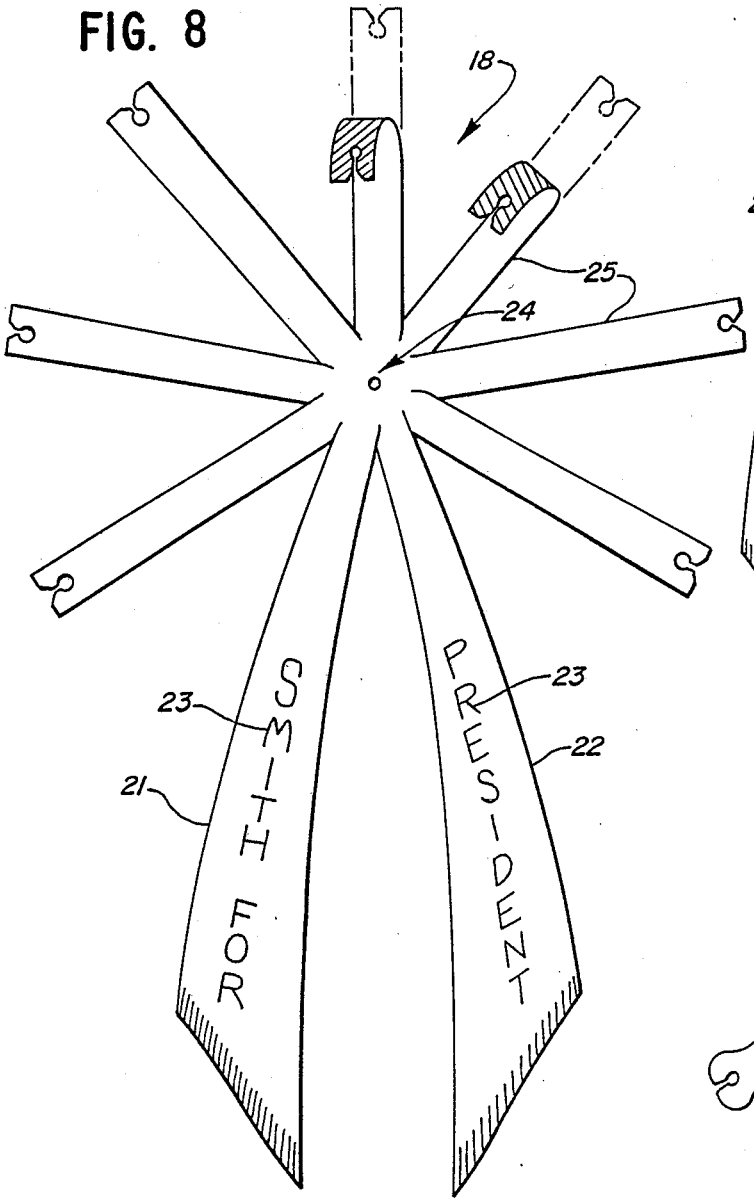
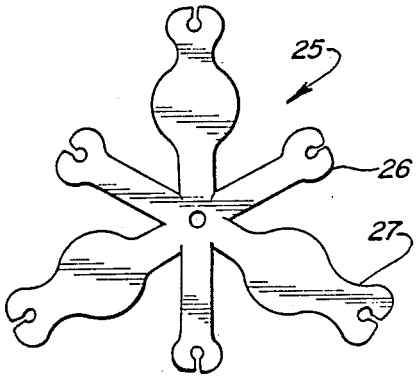
FIG. 10

DECORATIVE MULTI-LOOP DEVICE

BACKGROUND OF THE INVENTION

The use of decorative multi-loop devices, such as bows on various packages to enhance the appearance thereof, or as badges to promote an occasion, a cause or candidate, has been popular for many years. Such devices are frequently preformed and thus, when stored in bulk, require an inordinate amount of space or, when transporting them in bulk to a customer can be a difficult, costly operation because of space requirements, and/or a large number of such devices become damaged or severely disfigured in transit rendering them unmarketable or non-usable. Furthermore, such preformed devices are formed of one or more lengths of ribbon defining a plurality of continuous loops gathered so as to resemble a hand-tied bow. Where such a ribbon device is manually formed by the customer from a kit, the procedure to be followed in forming the device is frequently confusing and difficult to understand and/or requires the talents of a person possessed of a substantial amount of dexterity and skill. When the device is formed of a length or lengths of ribbon, it is very difficult, if not impossible, to register surface indicia along the length of the ribbon so that the indicia will appear at specific locations on the finished device. Furthermore, the surface indicia on the ribbon is a repeat pattern preprinted by gravure, flexography or other well known rotary printing processes.

SUMMARY OF THE INVENTION

By way of contrast the improved decorative device overcomes the aforenoted shortcomings associated with prior decorative devices of this general type.

The improved device is formed from a blank of sheet material which may remain in an unfolded state for storage and for shipping in bulk.

The blank of the improved device may be readily preprinted by a wide variety of printing procedures (i.e., lithography, hot foil, silk screening, embossing, etc.) thereby allowing precise registry of portions of the surface design to specific locations on the blank.

Because the loops of the device may be formed from a single blank of sheet material, a surface design may be readily applied to the blank by high speed, sheet-fed, automatic equipment of conventional construction.

The blank for the improved decorative device may be readily die cut to form the desired number of loop-forming segments of the same or varied configurations.

The improved decorative device may be readily formed by automatic or semi-automatic equipment, or by simple manual manipulations.

The improved decorative device after use may have the loop-forming segments thereof disassembled from the loop-retaining means whereby the device may be stored in a flattened condition until subsequent reuse.

Further and additional features and advantages of the improved decorative device will become apparent from the description, accompanying drawings and appended claims.

In accordance with one embodiment of the invention, a decorative multi-loop device is provided which is formed from a blank of foldable sheet material. The blank includes a central section and a plurality of loop-forming segments integral with and projecting laterally outwardly from the central section. A loop-retaining means cooperates with the blank. Each loop-forming segment may be independently adjustable relative to the central section and define a decorative loop. The distal end of each segment, when in the loop-forming mode, is engaged and retained in such mode by the loop-retaining means.

BRIEF DESCRIPTION OF THE DRAWINGS

For a more complete understanding of the invention, reference is made to the drawings wherein:

FIG. 1 is a top plan view of a blank of sheet material precut and preprinted for forming one embodiment of the improved decorative device; for clarity, only four of the loop-forming segments are shown with surface designs.

FIG. 2 is an enlarged perspective view per se of one embodiment of a loop-retaining means.

FIG. 2A is similar to FIG. 2 but of second embodiment, of a loop-retaining means.

FIG. 2AA is an enlarged fragmentary top view of FIG. 2A showing the protuberance thereof in an inoperative mode.

FIG. 2B is similar to FIG. 2 but showing a third embodiment of a loop-retaining means.

FIGS. 3–6 are perspective views showing successive steps in manually forming of one embodiment of the improved decorative device utilizing the blank and loop-retaining means shown, respectively, in FIGS. 1 and 2.

FIG. 7 is a fragmentary perspective view of the blank of FIG. 1 and showing some of the loop-forming segments thereof defining esthetic twisted loops.

FIG. 8 is similar to FIG. 1 but showing a modified blank which is particularly suitable for forming a decorative badge.

FIG. 9 is a perspective front view of the decorative badge formed from the blank of FIG. 8.

FIG. 10 is similar to FIG. 1 but showing a third embodiment of a blank.

FIG. 11 is a perspective view on a reduced scale of a further embodiment of the decorative device utilizing at least two blanks.

Referring now to the drawings and more particularly to FIG. 6, one embodiment of the improved decorative multi-loop device in the form of a bow 10 is shown. The bow, as illustrated, is formed from a blank 11 of sheet material (FIG. 1) and a peg piece 12 (FIG. 2).

The blank may have various configurations, but as shown in FIG. 1 includes a central section 13 and a plurality of loop-forming segments 14A–14R which extend laterally outwardly from the central section. The number, size and shape of the segments may vary from that shown and will depend upon the desired esthetic appearance of the finished bow 10. Furthermore, the segments in a given blank may vary in length and configuration, see FIGS. 8 and 10.

The sheet material of which the blank is formed may be of paper, plastic or the like on which surface designs or indicia X and Y may be readily applied by various well known processes such as lithography, hot foil, silk-screening, embossing and the like. Such surface designs are normally applied to the blank 11 while in an uncut state, thus enabling predetermined portions of the surface design to be readily registered with selected areas of the blank. Thus, when the bow is in a finished state (FIG. 6), the predetermined surface design portions will appear at selected locations, thereby creating a unique and artistic appearance, or setting forth a greeting or salutation, or the identity of a person, company or event.

The peg piece 12 may take various forms, but the embodiment shown in FIG. 2 is of molded unitary construction and includes a protuberance 12*a* which extends transversely from an enlarged, thin base 12*b*. The distal end of the protuberance forms a knob-like head 12*c*. The portion of the protuberance between the base 12*b* and head 12*c* forms a neck 12*d*. The function and disposition of the peg piece with respect to the blank 11 will be described more fully hereinafter.

In the illustrated blank 11, the loop-forming segments 14A–14R are symmetrically arranged about central section 13 and radiate outwardly therefrom when the blank is in an unfolded state. Except for the surface designs X and Y the segments are of like configuration and thus, only segment 14A will be described in detail. The distal or outer end portion 14*a* of the segment is provided with an aperture 15 which is centrally aligned and sized to accommodate only the neck portion 12*d* of the peg piece 12. A notch-shaped slot 16 extends endwise from the aperture 15 and flares outwardly to a peripheral section of the segment. The narrowest portion of the slot 16 which is adjacent the periphery of the aperture 15, is slightly less than the thickness, or diameter, of the peg piece neck portion 12*d*. Thus, when the segment is being manipulated into the loop-forming mode, see FIGS. 4 and 5, the distal end portion 14*a* is positioned relative to the peg piece so that the neck portion 12*d* thereof is aligned with the flared end of the slot 16. The segment distal end portion 14*a* is then pushed towards the peg piece, while the latter remains stationary, causing the peripheral parts of the distal end portion defining the narrowest portion of the slot 16 to yield slightly under the pressure of the neck portion 12*d* thereby allowing the latter to pass therebetween and into the aperture 15. As seen in FIG. 5, when the segment is looped so that the distal end portion thereof is disposed on the same side of the central section 13 as the protruding head 12*c*, the distal end portion 14*a* is captured between the head 12*c* of the protuberance and the central section 13 when the neck 12*d* is accommodated in aperture 15. The head portion is sized so that under normal conditions it cannot pass transversely through the aperture.

Where segment 14A is looped in the opposite direction, see FIG. 4; that is to say, it is on the same side of the central section 13 as the base 12*b* of the peg piece 12, the same procedure is followed in accommodating the neck portion 12*d* in the aperture 15 except that the segment distal end portion 14*a* is captured between the base 12*b* of the peg piece 12 and the blank central section 13.

To facilitate mounting of the peg piece 12 on the blank central section, the latter is provided with a centrally oriented opening 13*a*. The opening may be provided with diametrically opposed peripheral slots, not shown, which allows expansion of the opening to permit the enlarged head 12*c* of the peg piece to initially pass therethrough.

While the peg piece 12 is shown as a molded unitary construction, it is not limited thereto but may be formed of a foldable sheet material (i.e. corrugated fiberboard) wherein the piece initially assumes a substantially flat configuration thereby facilitating storage or shipping thereof in bulk. When the bow is to be formed, the protuberance which is foldably connected to the base, may be adjusted to a transverse, upright position. Once the protuberance has been so adjusted the head end of the protuberance is then inserted through the central section opening 13*a*.

FIGS. 2A and 2AA show a second embodiment 12' of the peg piece wherein the base 12'*b* thereof is disc-shaped and formed of a thin plastic material. A radially extending slot K is formed in the base and accommodates a protuberance 12'*a*. The inner end 12'*e* of the protuberance may be ball-shaped and integral with a transverse piece 12'*f* which serves as the pivot axis for the protuberance, see FIG. 2AA. The outer end 12'*c* of the protuberance may be ball-shaped. The ends of piece 12'*f* are integral with the sides of the slot K. The base and protuberance are molded together and the protuberance normally assumes the inoperative, or radial, position. When the device is to be formed, the protuberance 12'*a* assumes the upright (transverse) position shown in phantom lines in FIG. 2A.

FIG. 2B illustrates a third embodiment of the peg piece 12'' which is of unitary construction and has a T-shape configuration. The base or cross portion 12''*b* of the peg piece is relatively narrow and extends laterally in opposite directions from one end of the protuberance 12''*a*.

Where all of the segments of a blank, when in the loop-forming mode, are to be disposed on the same side of the blank central section, the loop retaining means 12 may be affixed by adhesive or other suitable means to either side of the blank central section.

As seen in FIG. 1, the adjacent loop-forming segments have the inner end portions 14*b* thereof separated from one another by a pair of short radially extending slits 17. The inner end of the slit terminates at the periphery of the central section. The lengths of the slits may be the same, as shown, or they may vary, and will depend upon the desired esthetic appearance of the finished bow.

FIG. 7 is a fragmentary perspective view of a partially finished bow 10' The difference in forming bow 10 and bow 10' is that in the latter the segments thereof are twisted approximately ninety degrees (90°) before the distal end portions are moved into interlocking engagement with the peg piece 12, 12' or 12''. Thus, the open sides of the loops of bow 10' face upwardly rather than sidewise as in the case of bow 10, see FIG. 6 and a different esthetic appearance is achieved.

A blank 18, shown in FIG. 8, is adapted to readily form the badge 20 of FIG. 9. Badge 20 may incorporate streamers or tails 21, 22 on which may be preprinted indicia 23 promoting a political candidate, political party, or a particular occasion or event (e.g. birthday, anniversary or athletic contest). As seen in FIG. 8, the streamers 21,22 extend downwardly from a central section 24 of the blank. Symmetrically arranged loop-forming segments 25 extend outwardly from the remainder of the central section periphery. The segments may be of like configuration and similar in shape to the segments 14A-R of blank 11, previously described. If desired, however, the segments 25 may be of different colors, particular on the exposed surfaces of the formed loops, thus, producing an attractive, eye-catching appearance. The central section 24 is provided with an opening 24*a* for accommodating a peg piece 12, 12' or 12''.

A third form of blank 25 is shown in FIG. 10 which differs from blanks 11 and 18 in that the loop-forming segments 26, 27 thereof have different configurations and lengths. Thus, when the segments are manipulated so as to form loops, the latter will have contrasting shapes thereby providing a unique and striking appearance. The distal ends of the segments 26, 27 may be shaped the same as segments 14A-R so as to readily accommodate the protuberance of the peg piece 12, 12' or 12".

While the various embodiments of the decorative device have heretofore been described as incorporating only a single blank 11, it is not intended that such devices are to be so limited. For example, two or more blanks BI and BII may be utilized, see FIG. 11, whereby the first blank BI is assembled on the peg piece 12 and the loop-forming segments thereof manipulated into engagement with the protuberance as previously described, and then the second blank BII would overlie the previously formed blank and be assembled over the outer end of the peg piece protuberance. The loop-forming segments of the second blank BII are then manipulated in the same fashion so that all of the loops are disposed on the same side of the peg piece base as the protuberance and interfit with one another. The number, size and shape of the blanks may vary. In lieu of multiple blanks in a single device, tags, trinkets, etc. may be assembled on the peg piece in combination with a blank. Additional variations of the improved device may be created utilizing the basic concepts of the invention.

Thus, a decorative multi-loop device has been provided which is of simple, inexpensive, yet versatile design; is easy to form; may be stored or shipped in bulk in a collapsed mode, and is reusable.

I claim:

1. A decorative multi-loop device comprising at least one blank of foldable sheet material, said blank including a central section and at least three loop-forming segments integral with and projecting laterally outwardly from said central section; and loop-retaining means on said blank; a predetermined number of said loop-forming segments being independently adjustable relative to said central section and defining decorative loops, each of said predetermined segments having a distal end portion in securing engagement with said loop-retaining means.

2. The decorative multi-loop device of claim 1 wherein a predetermined number of loop-forming segments radiate outwardly from the central section.

3. The decorative multi-loop device of claim 1 wherein selected areas of the blank have a predetermined decorative surface design.

4. The decorative multi-loop device of claim 3 wherein at least portions of the surface design are in registration with a selected number of said loop-forming segments.

5. The decorative multi-loop device of claim 1 wherein the loop-forming segments are substantially symmetrically arranged about the periphery of said central section.

6. The decorative multi-loop device of claim 1 wherein the loop-forming segments have a substantially uniform configuration.

7. The decorative multi-loop device of claim 1 wherein the loop-forming segments have substantially non-uniform configurations.

8. The decorative multi-loop device of claim 1 wherein the loop-retaining means includes a first locking component on said blank central section, and complemental second locking components on distal end portions of a predetermined number of said loop-forming segments, said first and second components coacting to retain said predetermined segments in loop-forming relation.

9. The decorative multi-loop device of claim 1 wherein a first set of loop-forming segments are looped so as to overlie one surface of the blank, and a second set of loop-forming segments are looped so as to overlie an opposing second surface of said blank.

10. The decorative multi-loop device of claim 8 wherein the first locking component includes a protuberance projecting from one surface of the central section, and the second locking component includes apertures formed in the distal end portions of said loop-forming segments for accommodating said protuberance.

11. The decorative multi-loop device of claim 10 wherein the aperture in each distal end portion communicates with a slot extending therefrom to a peripheral portion of said segment.

12. The decorative multi-loop device of claim 8 wherein the first locking component includes a peg piece having a protuberance extending through an opening formed in the central section and a base integral with said protuberance and impassable relative to the central section opening, said base being disposed adjacent one surface of said central section and said protuberance terminating in a head disposed adjacent an opposite second surface of said central section; the second locking component including apertures formed in distal end portions of said loop-forming segments, each aperture lockingly accommodating the peg piece protuberance when said segments are in loop-forming relation.

13. The decorative multi-loop device of claim 12 wherein the peg piece protuberance includes a neck portion connecting the head to the base; the aperture in each loop-forming segment communicates with a slot extending therefrom to a peripheral portion of the segment; said slot being sized to accommodate only the protuberance neck portion and the head being impassable relative to the distal end portion aperture.

14. A decorative multi-loop device formed from a blank of foldable sheet material, said blank including a central section and at least three loop-forming segments extending laterally outwardly from said central section, and loop-retaining means cooperating with said central section and distal end portions of said segments and retaining each segment in a loop forming mode.

15. The decorative multi-loop device of claim 14 wherein the loop-retaining means includes a peg piece mounted on said blank central section and having a protuberance projecting from a base disposed adjacent one side of said central section, said protuberance extending through said central section and terminating on an opposite side thereof, said protuberance interlockingly engaging apertures formed in distal end portions of said segments when the latter are in a loop-forming mode.

16. The decorative multi-loop device of claim 15 wherein the peg piece is removably mounted on the blank central section.

17. The decorative multi-loop device of claim 15 wherein the peg piece is of molded unitary construction.

18. The decorative multi-loop device of claim 1 wherein selected segments of the blank have greater lengths than the remaining segments.

19. The decorative multi-loop device of claim 18 wherein the selected segments of the blank define elongate streamers in the decorative device.

20. A decorative multi-loop device comprising a plurality of blanks of foldable sheet material arranged in substantially superposed relation, each blank including a central section and at least three loop-forming segments integral with and projecting laterally outwardly from said central section; and a loop-retaining means on said blank; a predetermined number of loop-forming segments of each blank being independently adjustable relative to the central section thereof and defining decorative loops, each of said predetermined segments having a distal end portion in securing engagement with the loop-retaining means.

21. The decorative multi-loop device of claim 20 wherein the decorative loops of one blank interfit with the decorative loops of a second blank.

* * * * *